US008656877B2

(12) United States Patent
Hiramatsu et al.

(10) Patent No.: US 8,656,877 B2
(45) Date of Patent: Feb. 25, 2014

(54) VEHICLE ENGINE

(75) Inventors: Naoki Hiramatsu, Nishio (JP); Masahide Sakurai, Nishio (JP)

(73) Assignee: Otics Corporation, Aichi (JP)

( * ) Notice: Subject to any disclaimer, the term of this patent is extended or adjusted under 35 U.S.C. 154(b) by 271 days.

(21) Appl. No.: 12/902,245

(22) Filed: Oct. 12, 2010

(65) Prior Publication Data

US 2011/0083627 A1 Apr. 14, 2011

(30) Foreign Application Priority Data

Oct. 13, 2009 (JP) ..... 2009-236226

(51) Int. Cl.
*F01M 1/06* (2006.01)

(52) U.S. Cl.
USPC ..... 123/90.33; 123/90.27; 123/90.34; 74/567

(58) Field of Classification Search
USPC ..... 123/90.33, 90.27, 90.34, 90.36, 90.39; 74/567
See application file for complete search history.

(56) References Cited

U.S. PATENT DOCUMENTS

| | | | | |
|---|---|---|---|---|
| 4,754,729 | A * | 7/1988 | Abe et al. | 123/90.38 |
| 7,165,522 | B2 | 1/2007 | Malek et al. | |
| 2005/0252470 | A1 | 11/2005 | Malek et al. | |
| 2007/0006444 | A1 * | 1/2007 | Makimae et al. | 29/525.01 |

FOREIGN PATENT DOCUMENTS

| | | |
|---|---|---|
| DE | 102 50 303 | 5/2004 |
| JP | 61-160210 | 10/1986 |
| JP | 2008-106701 | 5/2008 |

* cited by examiner

*Primary Examiner* — Zelalem Eshete
(74) *Attorney, Agent, or Firm* — Wenderoth Lind & Ponack L.L.P.

(57) ABSTRACT

A vehicle engine includes: a cylinder head; a cam housing fixed to a top of the cylinder head; a cam cap fixed to a top of the cam housing; a camshaft rotatably supported between the cam housing and the cam cap, the camshaft supporting a cam; a rocker arm configured to be pushed by the cam; and a valve configured to operate by being pushed by the rocker arm; and an oil pipe that is formed integrally with the cam cap. Lubricant oil is supplied through the oil pipe to a contact point between the cam and the rocker arm.

14 Claims, 6 Drawing Sheets

VEHICLE ENGINE

CROSS REFERENCE TO RELATED APPLICATION

This application claims priority from Japanese Patent Application No. 2009-236226 filed on Oct. 13, 2009. The entire content of this priority application is incorporated herein by reference.

TECHNICAL FIELD

The present invention relates to a vehicle engine.

BACKGROUND

A typical vehicle engine includes a cylinder head, a cam housing, a cam cap, camshafts, rocker arms, and valves. The cam housing is fixed to a top of the cylinder head. The cam cap is fixed to a top of the cam housing. The camshafts are rotatably supported between the cam housing and the cam cap. Each camshaft supports cams. The cams push the rocker arms, while the rocker arms push the valves so that the valves operate. One of such typical vehicle engines further includes a shower pipe wherethrough lubricant oil is supplied to contact points between the cams and the rocker arms.

The shower pipe is generally a separate part attached to the cam cap or to a head cover that covers the top of the cam cap. That is, a part separate from the cam cap or from the head cover is necessary as the shower pipe. The parts count of the vehicle engine is higher accordingly.

Thus, there is a need for a vehicle engine with a lower parts count.

SUMMARY

An aspect in accordance with the present invention is a vehicle engine including: a cylinder head; a cam housing fixed to a top of the cylinder head; a cam cap fixed to atop of the cam housing; a camshaft rotatably supported between the cam housing and the cam cap, the camshaft supporting a cam; a rocker arm configured to be pushed by the cam; a valve configured to operate by being pushed by the rocker arm; and an oil pipe configured to supply lubricant oil to a contact point between the cam and the rocker arm. The oil pipe is formed integrally with the cam cap.

DETAILED DESCRIPTION

First Embodiment

A first embodiment in accordance with the present invention will be described with the drawings.

Figure 1:
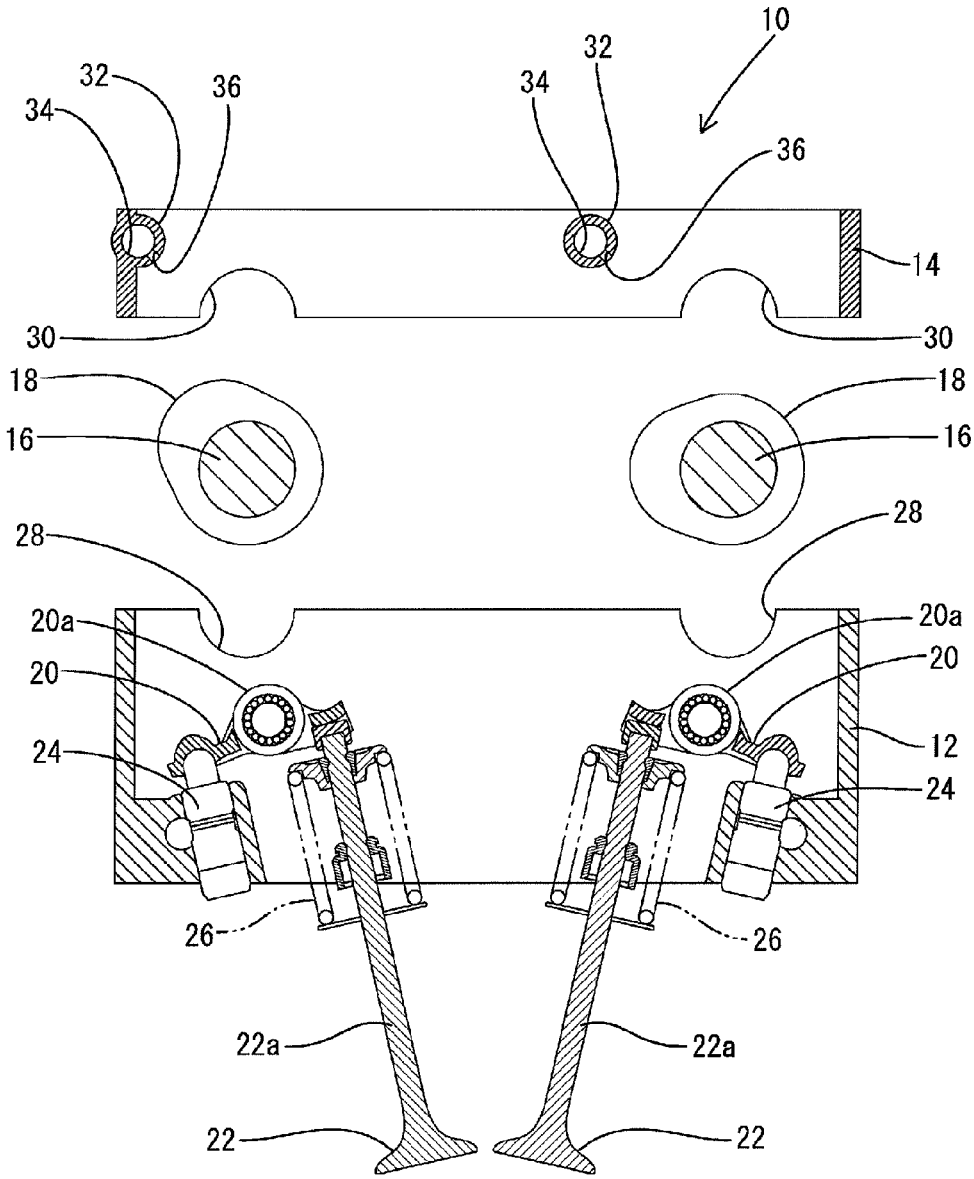
FIG. 1 is a sectional view of a vehicle engine of a first embodiment, illustrating a state before the cam cap is mounted to the cam housing.
Figure 2:
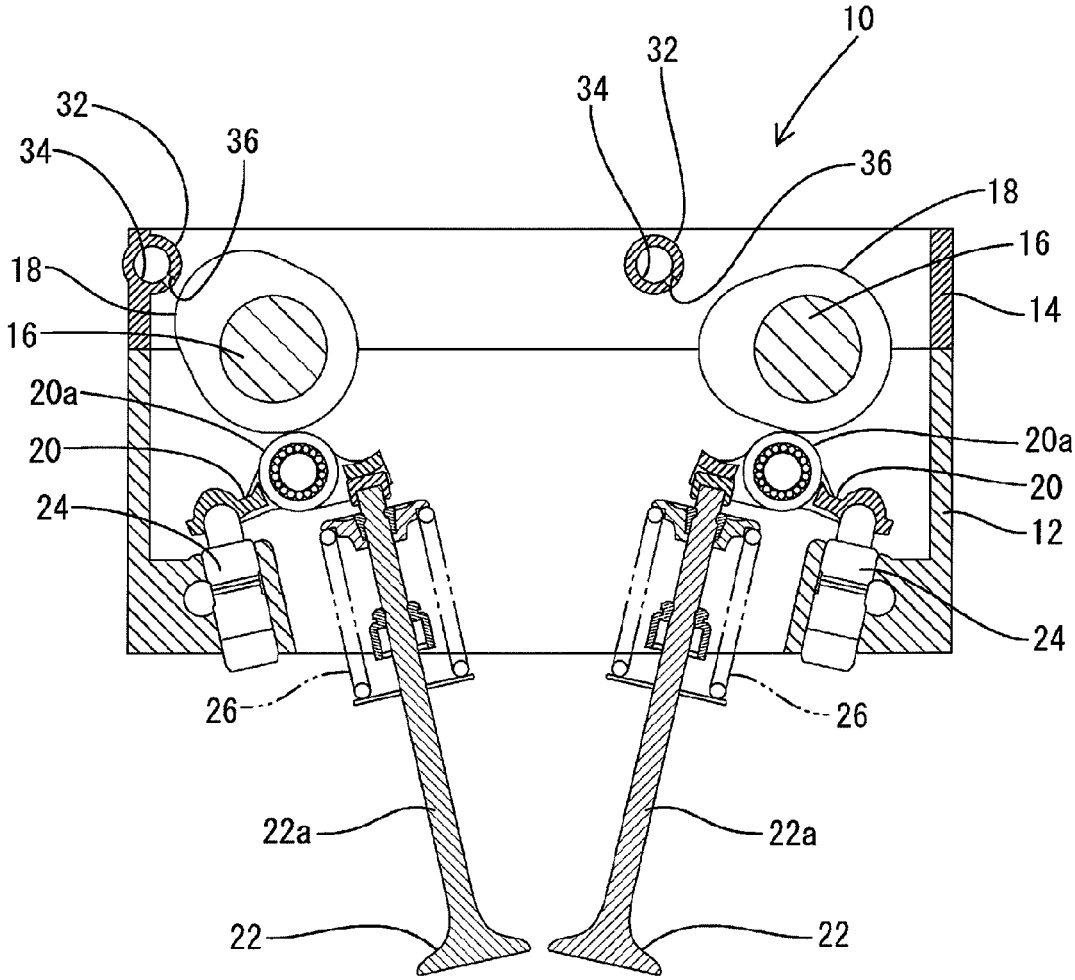
FIG. 2 is a sectional view of the vehicle engine of the first embodiment, illustrating a state after the cam cap is mounted to the cam housing.

As illustrated in FIGS. 1 and 2, a vehicle engine 10 of this embodiment includes a cylinder head (not illustrated in the drawings), a cam housing 12, a cam cap 14, camshafts 16, rocker arms 20, and valves 22. The cam housing 12 is fixed to a top of the cylinder head. The cam cap 14 is fixed to a top of the cam housing 12. Each camshaft 16 is rotatably supported between the cam housing 12 and the cam cap 14. The camshaft 16 supports cams 18. The cams 18 push the rocker arms 20. The rocker arms 20 push the valves 22 so that the valves 22 operate. The vehicle engine 10 is a so-called DOHC engine, including the left and right camshafts 16 for operating the intake and exhaust valves 22, respectively.

The cam housing 12 is bolted on the top of the cylinder head. The cam housing 12 accommodates the rocker arms 20, the valves 22, lash adjusters 24, and valve springs 26. An end of each rocker arm 20 is supported from below by the corresponding lash adjuster 24, while the other end contacts a stem 22*a* of the corresponding valve 22 from above. As a crankshaft (not illustrated in the drawings) rotates, the camshafts 16 rotate so that the cams 18 push down rollers 20*a* of the rocker arms 20. Then, the rocker arms 20 swing up and down about top ends of the lash adjusters 24 while reciprocating the valves 22 up and down against the elastic forces of the valve springs 26. Thus, the camshafts 16, the cams 18, the rocker arms 20, the lash adjusters 24, and the valve springs 26 are accommodated in the cam housing 12 and configure a valve train for operating the valves 22.

The cam cap 14 is bolted on the top of the cam housing 12. The cam housing 12 and the cam cap 14 are made of metal such as aluminium alloy. The cam housing 12 and the cam cap 14 can be manufactured by, for example, die casting.

Figure 3:
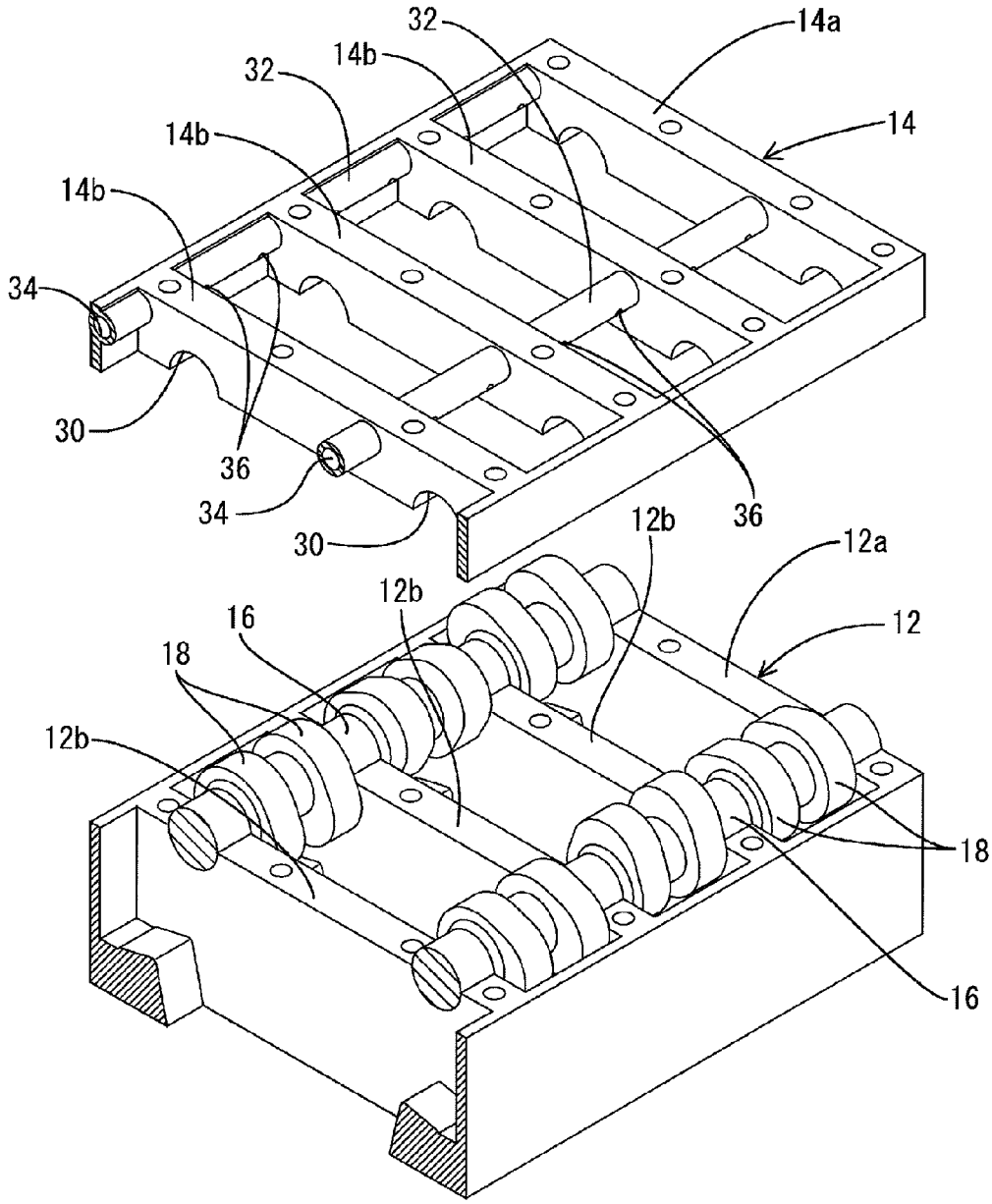
FIG. 3 is a perspective view of the cam housing, a camshaft, and the cam cap of the first embodiment.

As illustrated in FIG. 3, the cam housing 12 includes a rectangular outer frame 12*a* and partitions 12*b*. The outer frame 12*a* defines a space, while the partitions 12*b* partition the space into a plurality of subspaces. Similar to this, the cam cap 14 includes a rectangular outer frame 14*a* and partitions 14*b*. The outer frame 14*a* defines a space, while the partitions 14*b* partition the space into a plurality of subspaces. Each of the subspaces defined by the partitions 12*b*, 14*b* accommodates the valve train components for operating the cylinder valves 22 of the vehicle engine 10.

Each camshaft 16 is a round bar made with metallic material such as JIS STKM (Carbon Steel Tubes for Machine Structural Purposes). The plurality of cams 18 are integrally provided on the circumference of the camshaft 16. The cams 18 are arranged in the axial direction of the camshaft 16.

Each camshaft 16 is rotatably supported between the cam housing 12 and the cam cap 14. Specifically, the camshaft 16 is rotatably supported between bearing recesses 28 and bearing recesses 30. Each of the bearing recesses 28, 30 is generally semicircular in cross section. The bearing recesses 28 are formed in the top face of the cam housing 12. The bearing recesses 30 are formed in the bottom face of the cam cap 14 (see FIG. 1).

Two oil pipes 32 are integral parts of the cam cap 14. Through the oil pipes 32, lubricant oil (hereinafter simply referred to as "oil") is supplied to the contact points between the cams 18 and the rollers 20*a* of the rocker arms 20. The oil pipes 32 can be formed integrally with the cam cap 14 in, for example, a die-casting process for manufacturing the cam cap 14. The oil pipes 32 extend substantially parallel to the axial direction of the camshafts 16 and through the thicknesses of the partitions 14*b*. The oil pipe 32 has a center hole 34 running through the axis thereof. The center hole 34 is bored with a tool such as a drill. The center hole 34 is an oil flow path.

The oil pipe 32 has a plurality of oil holes 36 arranged at predetermined intervals in the axial direction of the oil pipe 32. Each oil hole 36 is approximately from 1 mm to 2 mm in diameter. The oil hole 36 runs through the thickness of the pipe wall of the oil pipe 32, obliquely downward from the center hole 34.

An oil pump pumps up oil from an oil pan. The oil is then forced through an oil gallery (not illustrated in the drawings) in the cam housing 12 and in the cam cap 14 to the oil pipes 32, and then is injected from the oil holes 36 toward the cams 18 and the rocker arms 20. Thus, oil is supplied to the contact points between the cams 18 and the rocker arms 20.

In a state where the cam cap 14 is mounted to the cam housing 12 as illustrated in FIG. 2, the oil pipes 32 are located above the cams 18. Accordingly, even in the event of lower oil pressure in the oil pipes 32 due to oil pump trouble etc., the oil in the oil pipes 32 can fall by its own weight from the oil holes 36. Oil can thus be continuously supplied to the contact points between the cams 18 and the rocker arms 20.

As described above, the vehicle engine 10 of this embodiment includes the oil pipes 32 that are provided integrally with the cam cap 14. Therefore, no member separate from the cam cap 14 or from the head cover is necessary as the oil pipes 32. The parts count of the vehicle engine 10 can be lower accordingly.

Second Embodiment

A second embodiment in accordance with the present invention will be described with reference to the drawings.

A vehicle engine 50 of this embodiment differs from the engine 10 of the first embodiment in the configuration of the cam cap and the oil pipe. The other configurations are similar to the first embodiment. Accordingly, the components similar to those of the first embodiment will be designated with the same reference characters, while the description will be omitted.

Figure 4:
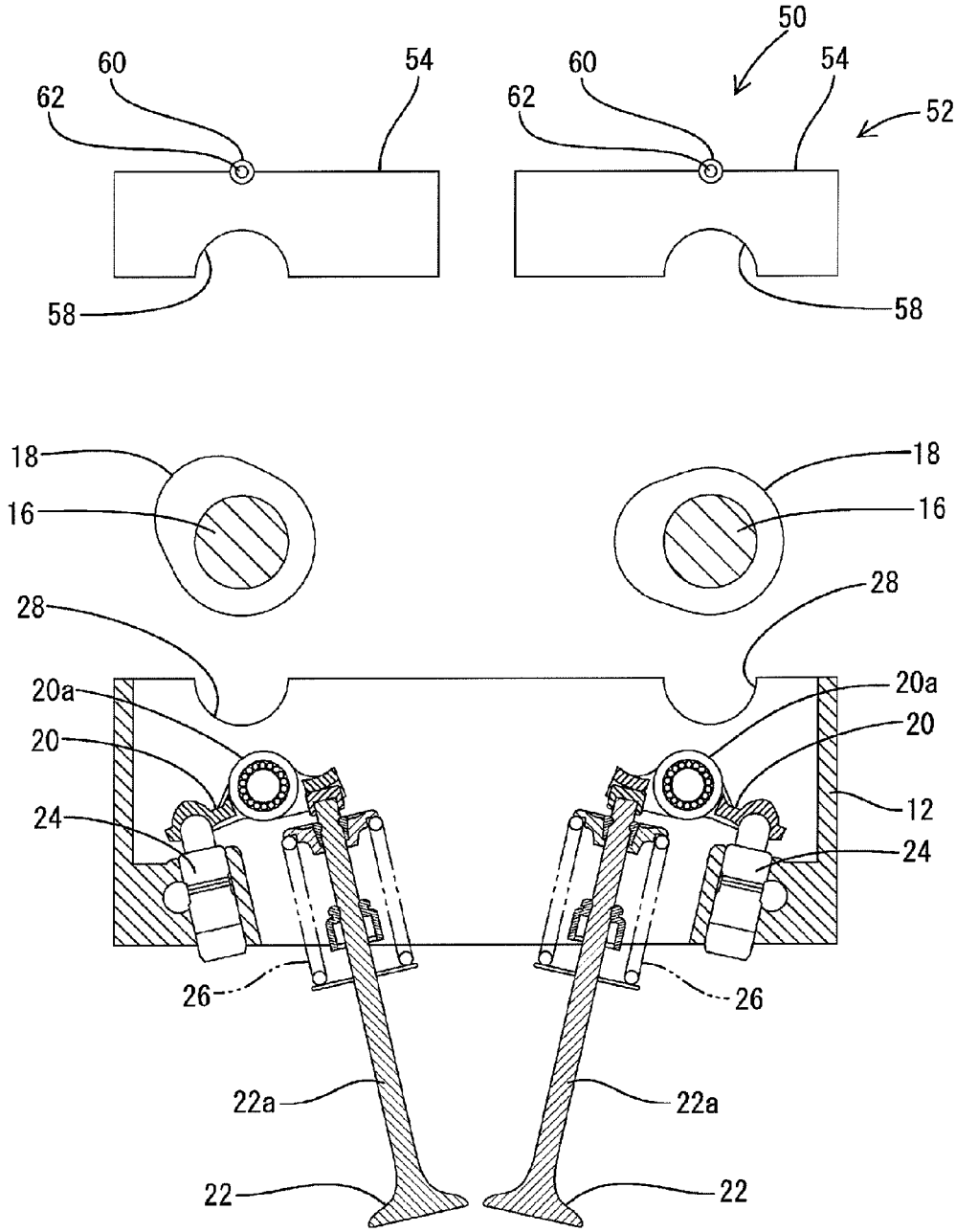
FIG. 4 is a sectional view of a vehicle engine of a second embodiment, illustrating a state before a cam cap is mounted to the cam housing.
Figure 5:
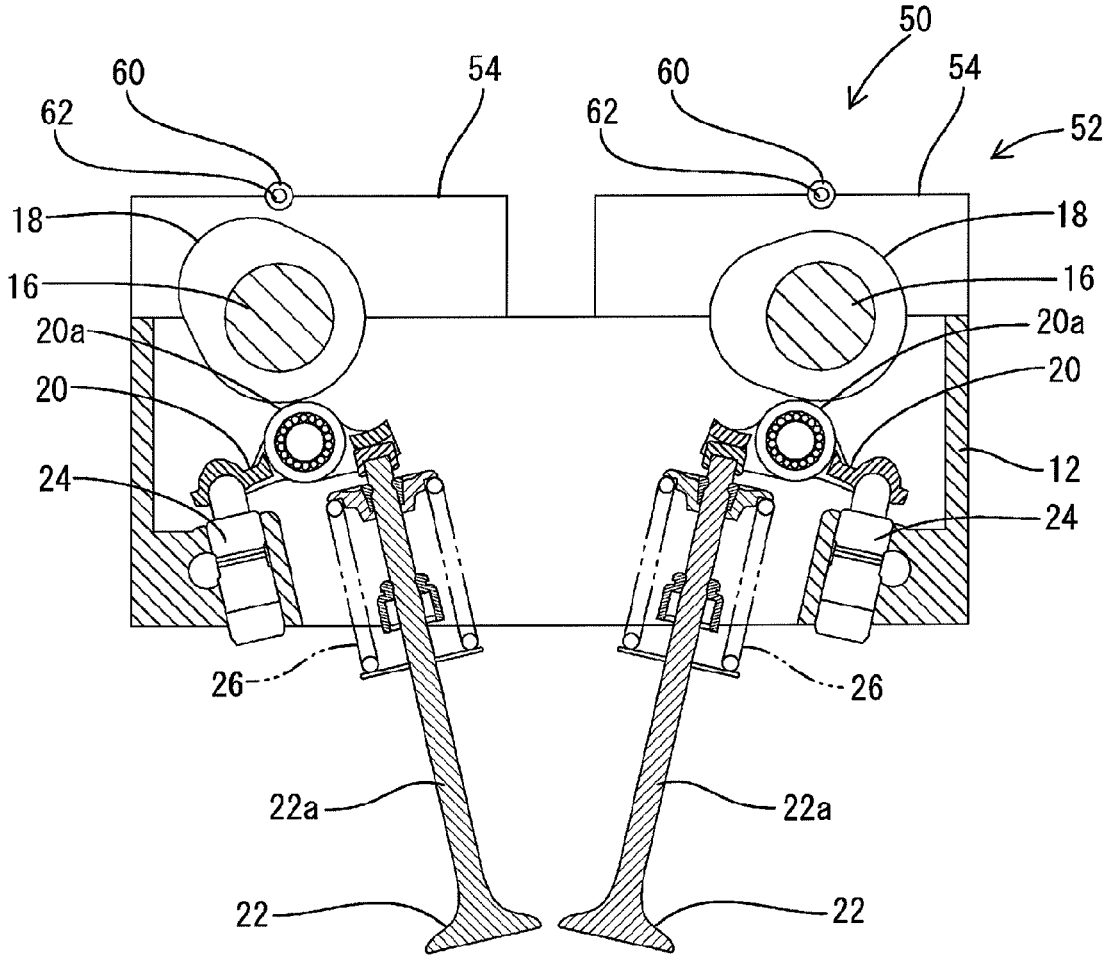
FIG. 5 is a sectional view of the vehicle engine of the second embodiment, illustrating a state after the cam cap is mounted to the cam housing.
Figure 6:
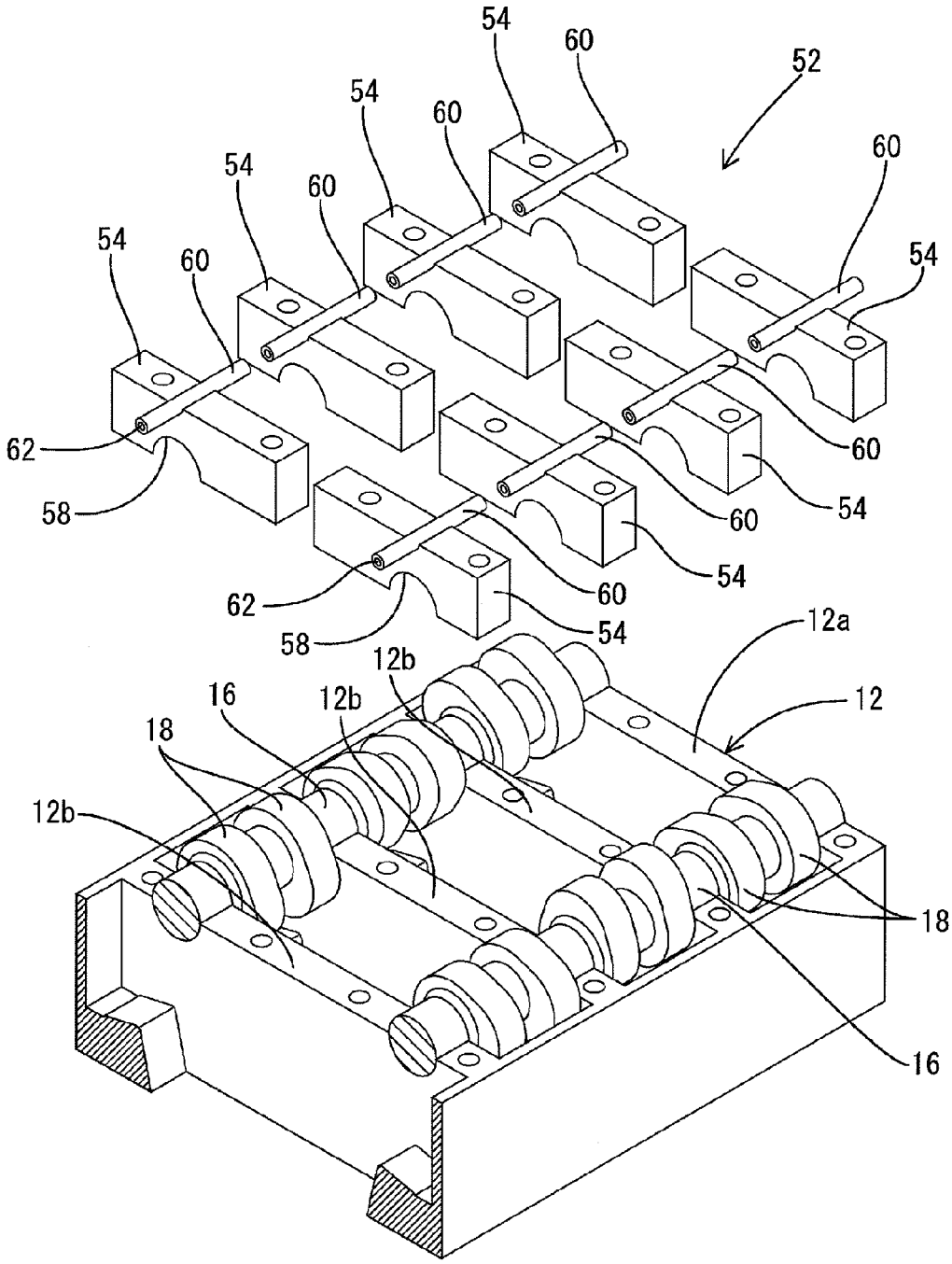
FIG. 6 is a perspective view of the cam housing, a camshaft, and a cam cap of the second embodiment.

As illustrated in FIGS. 4 through 6, the vehicle engine 50 includes a plurality of plate-like bodies 54 that configure a cam cap 52. The plate-like bodies 54 are bolted on a top of the cam housing 12. The plate-like bodies 54 partition the plurality of cams 18 into groups of two cams 18. The plate-like bodies 54 are made by metallic material such as aluminium alloy. The plate-like bodies 54 can be manufactured by, for example, die casting.

Each camshaft 16 is rotatably supported between the cam housing 12 and the cam cap 52. Specifically, the camshaft 16 is rotatably supported between the bearing recesses 28 and bearing recesses 58. Each of the bearing recesses 28, 58 is generally semicircular in cross section. The bearing recesses 28 are formed in the top face of the cam housing 12. The bearing recesses 58 are formed in the bottom faces of the plate-like bodies 54.

Oil pipes 60 are integral parts of the respective plate-like bodies 54. The oil pipes 60 are disposed on the top face of the respective plate-like bodies 54. Through the oil pipes 60, oil is supplied to the contact points between the cams 18 and the rollers 20*a* of the rocker arms 20. The oil pipe 60 can be formed integrally with the plate-like bodies 54 in, for example, a die-casting process for manufacturing the plate-like bodies 54. The oil pipes 60 extend substantially parallel to the axial direction of the camshafts 16. The oil pipe 60 has a center hole 62 running through the axis thereof. The center hole 62 is bored with a tool such as a drill. The center hole 62 is an oil flow path. The center hole 62 is open-ended in the two ends of the oil pipe 60.

The oil pump pumps up oil from an oil pan. The oil is then forced through the oil gallery (not illustrated in the drawings) in the cam housing 12 and in the cam cap 52 to the oil pipes 60, and then falls from both ends of the oil pipes 60 toward the cams 18 and the rocker arms 20. Thus, oil is supplied to the contact points between the cams 18 and the rocker arms 20.

In the state where the cam cap 52 is mounted to the cam housing 12 as illustrated in FIG. 5, the oil pipes 60 are located above the cams 18. Accordingly, even in the event of lower oil pressure in the oil pipes 60 due to oil pump trouble, the oil in the oil pipes 60 can fall by its own weight from the both ends of the oil pipes 60. Oil can thus be continuously supplied to the contact points between the cams 18 and the rocker arms 20.

As described above, the vehicle engine 50 of this embodiment includes the oil pipes 60 that are provided integrally with the cam cap 52. Therefore, no member separate from the cam cap 52 or from the head cover is necessary as the oil pipes 60. The parts count of the vehicle engine 50 can be lower accordingly.

What is claimed is:

1. A vehicle engine comprising:

a cylinder head;

a cam housing provided to the cylinder head and having a first cam housing bearing recess;

a cam cap fixed to the cam housing and having a first cam cap bearing recess, the cam cap including a first oil pipe;

a first camshaft rotatably supported between the first cam housing bearing recess and the first cam cap bearing recess;

a first cam provided to the first camshaft;

a first rocker arm configured to be pushed by the first cam;

a valve configured to operate by being pushed by the first rocker arm;

a second cam housing bearing recess provided in the cam housing;

a second cam cap bearing recess provided in the cam cap;

a second camshaft rotatably supported between the second cam housing bearing recess and the second cam cap bearing recess;

a second cam provided to the second camshaft;

a second oil pipe integrally formed with the cam cap as a single piece; and a second rocker arm configured to be pushed by the second cam, wherein the second oil pipe is configured to supply lubricant oil therethrough to a contact point between the second cam and the second rocker arm, wherein the first oil pipe is configured to supply lubricant oil therethrough to a contact point between the first cam and the first rocker arm, and wherein the first oil pipe and the cam cap are formed integrally as a single piece.

2. The vehicle engine of claim 1, wherein the cam cap includes a lower surface on which the first cam cap bearing recess is formed and an upper top surface that is opposite to the lower surface, and wherein the first oil pipe is provided below the upper top surface of the cam cap.

3. The vehicle engine of claim 1, wherein the cam cap and the first oil pipe are made of the same material.

4. The vehicle engine of claim 1, wherein each of the cam cap, the first oil pipe, and the cam housing is made of aluminum alloy.

5. The vehicle engine of claim 1, wherein the cam cap includes a plurality of plate bodies, and each of the plate bodies integrally includes a corresponding one of the first and second oil pipes.

6. The vehicle engine of claim 1, wherein the cam cap includes a plurality of plate bodies, and each of the plate bodies integrally includes a corresponding one of the first and second oil pipes, wherein the first camshaft includes a third cam and the second camshaft includes a fourth cam, and wherein the first oil pipe supplies lubricant oil to the first cam and the third cam, and the second oil pipe supplies lubricant oil to the second cam and the fourth cam.

7. The vehicle engine of claim 6, wherein each of the oil pipes has an opening path extending from a first end to a second end, and the lubricant oil exits from the second end of each of the oil pipes, and wherein each oil pipe is formed of a plurality of oil pipe segments which are separate pieces from each other, each oil pipe segment having a first end and a second end, and the oil pipe segments are configured and arranged such that oil exits from the second end of each oil pipe segment onto the respective camshafts.

8. The vehicle engine of claim 7, wherein the oil pipe segments are arranged in an axial direction of the respective oil pipe such that the first end of one of the oil pipe segments abuts the second end of an adjacent one of the oil pipe segments.

9. The vehicle engine of claim 7, wherein the plurality of oil pipe segments are formed integrally as a single piece with the plurality of plate bodies, respectively.

10. The vehicle engine of claim 1, wherein the first oil pipe, the second oil pipe, and the cam cap are formed integrally as a single piece.

11. The vehicle engine of claim 1, wherein the cam cap has an upper-most surface on an opposite side of the cam cap from the cam housing, and the first oil pipe is disposed below the upper-most surface of the cam cap and above the cam housing.

12. A vehicle engine comprising:

a cylinder head;

a cam housing provided to the cylinder head and having a first cam housing bearing recess;

a cam cap fixed to the cam housing and having a first cam cap bearing recess, the cam cap integrally including a first oil pipe;

a first camshaft rotatably supported between the first cam housing bearing recess and the first cam cap bearing recess;

a first cam provided to the first camshaft;

a first rocker arm configured to be pushed by the first cam;

a valve configured to operate by being pushed by the first rocker arm;

a second cam housing bearing recess provided in the cam housing;

a second cam cap bearing recess provided in the cam cap;

a second camshaft rotatably supported between the second cam housing bearing recess and the second cam cap bearing recess;

a second cam provided to the second camshaft;

a second oil pipe integral with the cam cap; and a second rocker arm configured to be pushed by the second cam, wherein the first oil pipe is configured to supply lubricant oil therethrough to a contact point between the first cam and the first rocker arm, wherein the second oil pipe is configured to supply lubricant oil therethrough to a contact point between the second cam and the second rocker arm, wherein the cam cap is formed in a rectangular shape having four side walls, and wherein one of the oil pipes and one of the four side walls are formed integrally as a single piece, and the one of the oil pipes extends along the one of the four side walls.

13. The vehicle engine of claim 12, wherein the cam cap has an upper-most surface on an opposite side of the cam cap from the cam housing, and the first oil pipe is disposed below the upper-most surface of the cam cap and above the cam housing.

14. The vehicle engine of claim 12, wherein the one of the four side walls has an inner surface, and the one of the oil pipes is disposed at the inner surface.

* * * * *